US006921853B2

(12) United States Patent
Taillard

(10) Patent No.: US 6,921,853 B2
(45) Date of Patent: Jul. 26, 2005

(54) LIP ELEMENT FOR INSTRUMENT WITH FLAPPING REED

(76) Inventor: Pierre-André Taillard, Rue du Cerisier 16A, 2300 La Chaux-de-Fonds (CH)

( * ) Notice: Subject to any disclaimer, the term of this patent is extended or adjusted under 35 U.S.C. 154(b) by 0 days.

(21) Appl. No.: 10/500,535

(22) PCT Filed: Dec. 23, 2002

(86) PCT No.: PCT/CH02/00720

§ 371 (c)(1),
(2), (4) Date: Jun. 30, 2004

(87) PCT Pub. No.: WO03/056543

PCT Pub. Date: Jul. 10, 2003

(65) Prior Publication Data

US 2005/0087057 A1 Apr. 28, 2005

(30) Foreign Application Priority Data

Dec. 31, 2001 (EP) ..... 01811275

(51) Int. Cl.[7] ..... G10D 9/02
(52) U.S. Cl. ..... 84/383 A

(58) Field of Search ..... 84/383 A, 380 R, 84/398

(56) References Cited

U.S. PATENT DOCUMENTS

| | | | | |
|---|---|---|---|---|
| 1,401,159 A | | 12/1921 | Lewerenz | |
| 2,181,880 A | | 12/1939 | Fauss | 84/383 |
| 2,495,484 A | | 1/1950 | Schemenauer | 84/383 |
| 5,018,425 A | * | 5/1991 | Rovner | 84/383 R |
| 6,501,010 B2 | * | 12/2002 | Sullivan | 84/383 R |

* cited by examiner

*Primary Examiner*—Kimberly Lockett

(57) ABSTRACT

The invention concerns a lip element for instrument with single flapping reed for instance for clarinet or saxophone, comprising mouthpiece (10), a reed (12) and a ligature for fixing the reed (12) to the mouthpiece (10). In said (14) is interposed between the reed (12) and the mouthpiece (10), thereby modifying the conditions in which the two each other, and in particular enabling to optimize the vibrational behavior of the reed (12), by virtually modifying the table of the mouthpiece (10). The insert consists of a thin plastic or metal film provided with an adhesive and has a bevelled profile.

20 Claims, 3 Drawing Sheets

LIP ELEMENT FOR INSTRUMENT WITH FLAPPING REED

Figure 1:
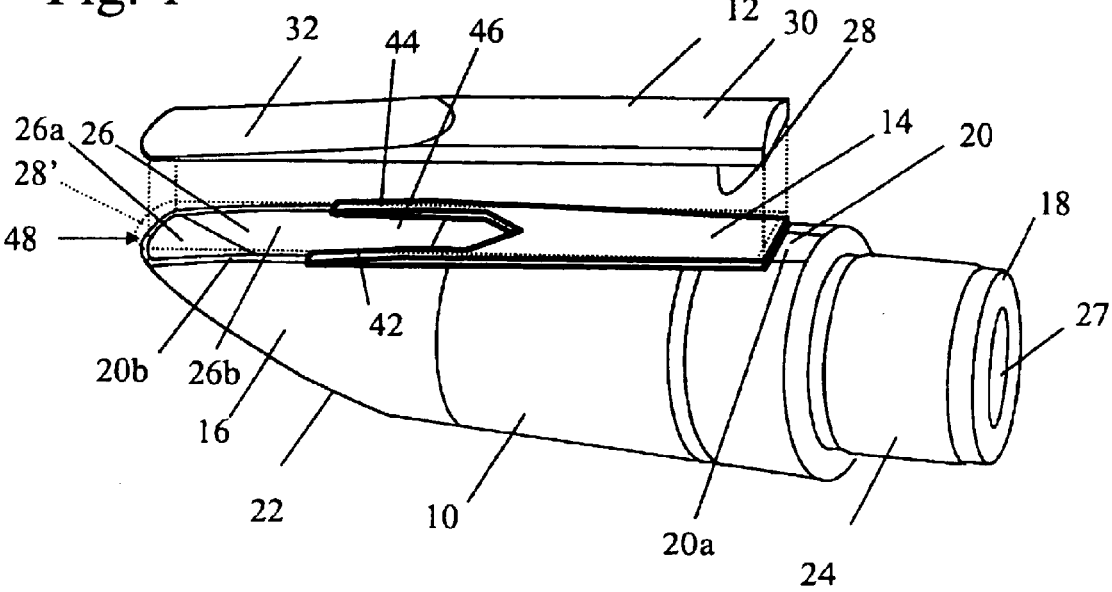

The present invention relates to instruments with a single beating reed, in particular to clarinets and saxophones, which include a bore forming an air column that is made to vibrate by the instrumentalist in order to generate sounds. It concerns more specifically the portion including a mouthpiece, a reed and a ligature intended to be placed in the mouth in order to insufflate air into the instrument and make the air column vibrate. In the present document, this portion is called the "mouthpiece assembly", in order to avoid any confusion with the term "embouchure" which here designates exclusively the way the instrument is held in the mouth. The mouthpiece includes a face or lay including a curved portion and a substantially flat portion intended to act as a support for the reed. The term "face" used without any further specificity always designates the mouthpiece face in the following description.

In order to properly understand the operation of this type of instrument, reference can advantageously be made to the work entitled "Clarinette mon amie" Ernest Ferron, editions IMD 1994.

Clarinetists have been complaining, since the invention of their instrument, three centuries ago, about the difficulty in obtaining reeds that perfectly satisfy their expectations. Thus, instrument manufacturers and inventors have sought to improve the performance of mouthpieces and reeds. Today, it is not so much the workmanship precision of the reed, made of natural reed, which is questioned, but rather the intrinsic irregularities of the material of which it is formed.

A reed can be considered like a spring whose features vary as a function of its shape, the structure of the material, its humidity level and the state of fatigue and chemical and structural transformation of the fibers that it comprises, due to aging and light.

It often happens that the reed itself is good, but that it does not interact in a satisfactory manner with the mouthpiece on which it is placed. The clarinetist takes another one or reworks it in order to fit it more intimately to the mouthpiece, an activity that requires significant savoir-faire.

Devices intended to be associated with the mouthpiece assembly have also been proposed, in order to obtain the best from available reeds, for example particular ligature models. Such a solution is disclosed in U.S. Pat. No. 1,896,814. In the instrument disclosed, the mouthpiece includes a groove in its lay, and the ligature is arranged so as to be able to exert pressure on the groove, so as to flex the reed and thereby modify the opening.

U.S. Pat. No. 3,791,253 discloses a ligature provided with a removable part capable of resting on the reed. By moving this part longitudinally, it is possible to modify the elastic features of the reed.

U.S. Pat. No. 2,224,719 provides the addition of a spring exerting pressure on the inner surface of the reed, the fixing and pressure being assured by a screw engaged in a hole comprised in the reed. This solution also modifies the elastic features of the reed. Moreover, the fact of piercing the reed can considerably change its behavior, in an unpredictable manner.

The improvements provided by the solutions that have just been described are limited, since in all three cases, only one parameter is targeted. However, it seems that in addition to the elasticity of the reed, which can be modified by the devices disclosed in U.S. Pat. Nos. 3,791,253 or 2,224,719, or the size of the opening comprised between the mouthpiece and the tip of the reed, which can be modified by means of the device disclosed in U.S. Pat. No. 1,896,814, five parameters relating to the interaction of the mouthpiece and the reed play an essential role. Three concern the curved portion of the face, namely its length, its curvature and its lateral asymmetry. Added to this are the interface conditions between the reed and the mouthpiece, and the inclination of the reed with reference to the baffle.

Other more significant modifications have-been proposed, requiring rearranging the mouthpiece structure in a significant manner. For example, U.S. Pat. No. 2,495,484 discloses a mouthpiece assembly, provided with a frame fixed by means of screws and taking the place of the mouthpiece face. A fork, fixed to the mouthpiece assembly, is arranged so as to be supported against the surface of the frame opposite the face. This type of improvement has a redhibitory drawback: that of not fitting the musician's instrument without any modification. Indeed, the latter has to either replace the mouthpiece that he is used to, or have his instrument modified by a professional.

It is an object of the present invention to overcome these drawbacks, by allowing better control of all the parameters influencing the interaction between the mouthpiece and the reed and fitting onto a standard mouthpiece—without requiring any modifications to its structure. According to the invention, the mouthpiece assembly includes:

- a mouthpiece fitted with:
  - a chamber, including a baffle, a wall opposite the baffle or ramp and two side walls, and a bore, for allowing air to flow and sound waves to circulate towards the pipe of the instrument, and
  - a first original face, including a curved portion, arranged laterally on either side of the chamber and forming the end of the walls, and a substantially flat portion arranged above the chamber and the bore, in the extension of the curved portion,
- a reed including
  - a stock, intended to be secured to the mouthpiece,
  - a vamp intended to vibrate, and
  - a table, extending over its entire length and forming one of the surfaces of the stock and the vamp,
  - arranged to be supported, via the portion of its table associated with the stock against the flat portion of the first face, and
- a ligature, for assuring the assembling of the reed on the mouthpiece.

In this mouthpiece assembly, the mouthpiece and the reed between them define an opening allowing air to penetrate, to generate sound vibrations. The air then flows into the chamber and into the bore, in a generally longitudinal direction.

The mouthpiece assembly is characterized in that it further includes, present during the production of sound, a removable insert taking the form of a patch, gripped between the mouthpiece face and the reed table, and arranged so as to define, with the first face, a second virtual face, as a function of the forms of the first face, the insert and the position of said insert on the first face. A patch will be defined in the present description as being a flexible piece, advantageously of a generally rectangular or trapezoidal shape, whose thickness is variable and substantially smaller than the other dimensions.

In this mouthpiece assembly, the insert can cover at least one part of the curved portion of the first face. Consequently, the length and/or curvature of the curved portion can be modified, and a longitudinal displacement allows its features to be finely modulated.

The present invention also concerns an insert intended to be fitted to such a mouthpiece assembly. This insert has a chamfer at at least one of its ends, intended to be arranged facing the vamp of the reed. Advantageously, the thickness of the end of the chamfer is less than 0.09 mm.

Advantageously the thickness of the insert is constant laterally and variable, along the longitudinal side, in accordance with a continuous function defined by sections, said sections, which are three in number, each being formed of a fourth degree polynomial, at least one of which has, over a length of more than 2 millimeters, at least two non zero coefficients.

Advantageously the film is formed of superposed thin sheets fixed to each other, the number of superposed sheets decreasing to form the chamfer.

In order to allow fine correction, the angle at the apex of the chamfer must be small, advantageously less than 3°.

The shape of the insert chamfer allows the features of the curved portion of the virtual face to be modified. Several shapes can be envisaged, selected in accordance with the modifications to be made.

In order to prevent too large a portion of the chamber being masked by the insert, its end including the chamfer is provided with a cut out portion made in the whole of its thickness and arranged laterally in its median part. This cut out portion defines two fingers arranged so as to rest on the curved portion of the mouthpiece face, and a scalloping defined by these fingers and intended to clear access to the chamber properly.

The choice of material plays a role in the working conditions of the reed on the mouthpiece. It is also necessary for the material used to allow the desired shape to be given to the insert and for its structure to be such that it does not vibrate with the reed during the production of sound. It is thus advantageous to use a material capable of being worked by plastic deformation, for example an aluminum alloy.

In the event that the interface has to be made of a not very elastic material, it is advantageous to make the insert in a plastic material.

If the latter is of the thermoformable type, the desired forms can be obtained by simple inexpensive means, by heating and pressing the parts to be deformed, by injection or by calendering.

It has become clear that by providing the insert with a repositionable type of adhesive layer, on a portion of one of its faces, it is possible to obtain sure and easily adjustable positioning. This layer can also act on the interface conditions between the reed and the mouthpiece. The thickness and the surface can thus be adjusted accordingly. Generally, however, the layer does not completely cover the insert, so that the latter can easily be detached.

Figure 2:
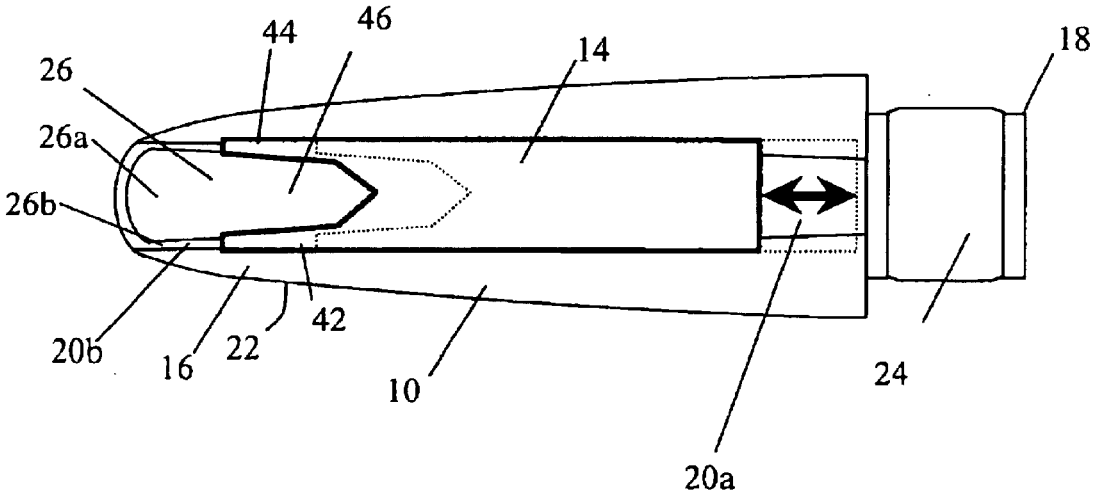
Figure 3:
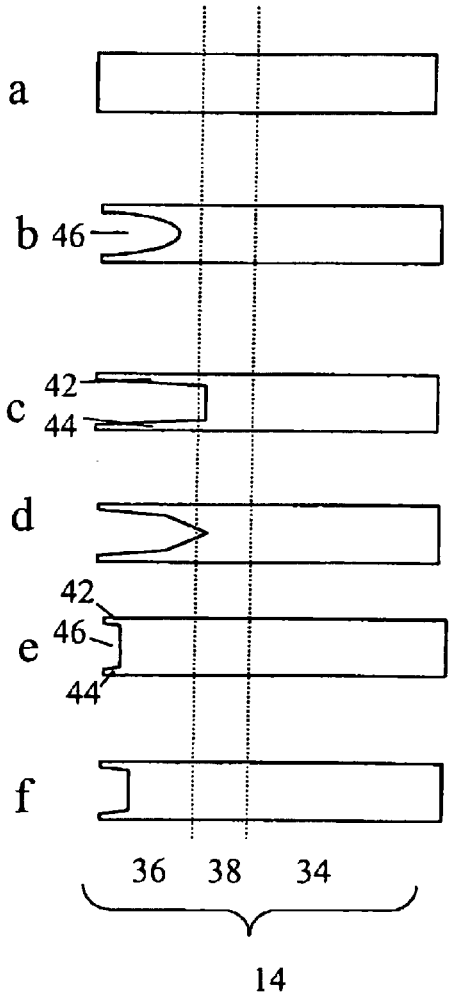
Figure 4:
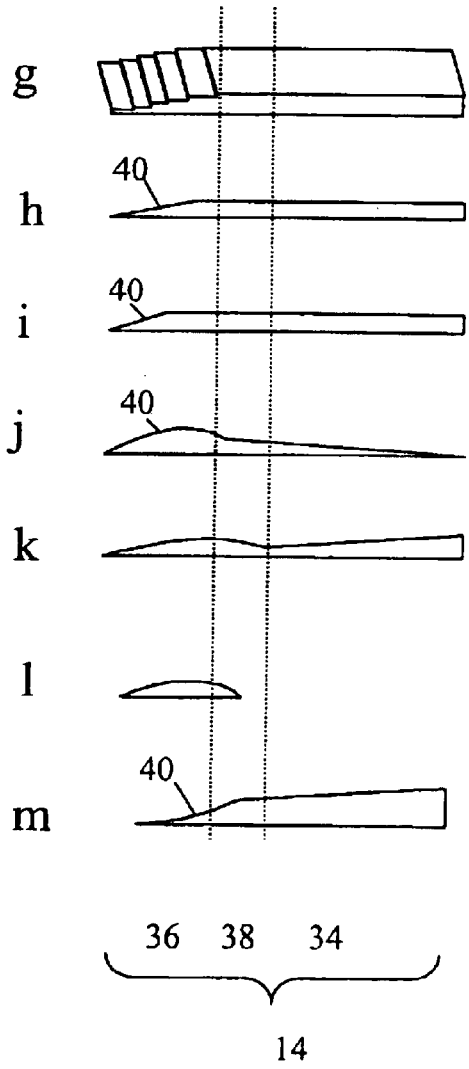
Figure 5:
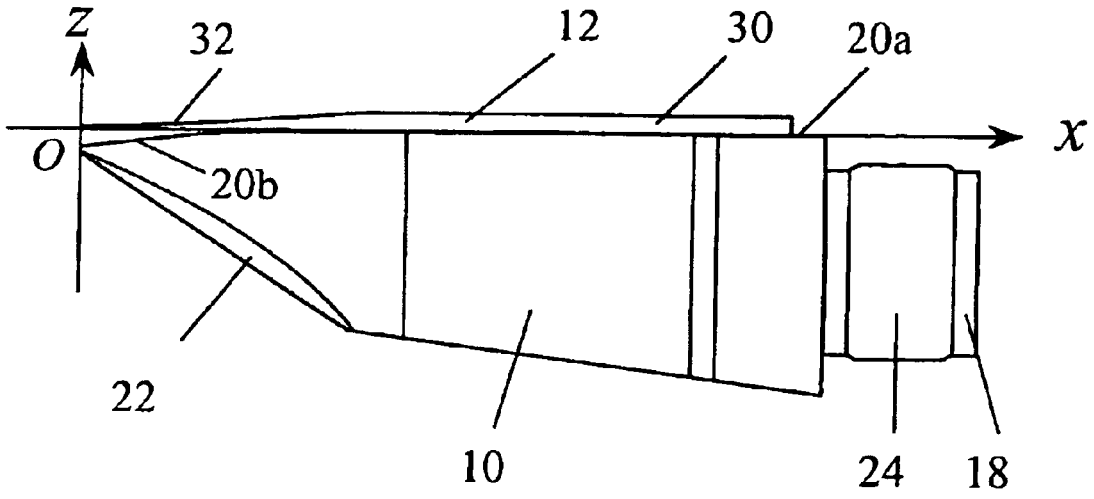

Other advantages and features of the invention will appear from the following description, made with reference to the annexed drawing, in which:

FIGS. 1 and 2 show a clarinet mouthpiece assembly according to the invention seen respectively in perspective and from the side thereof intended to receive a reed, defined as the "top" in the present description, FIGS. 3 and 4 respectively illustrate top and side views of various types of inserts capable of being fitted to the mouthpiece assembly according to the invention, FIG. 5 shows a profile view of a clarinet mouthpiece without an insert. It illustrates the system of axes Ox and Oz defined when a reed is fixed onto the substantially flat portion of the mouthpiece face, and FIG. 6 is a graph that shows how a thin insert is calculated.

Figure 6:
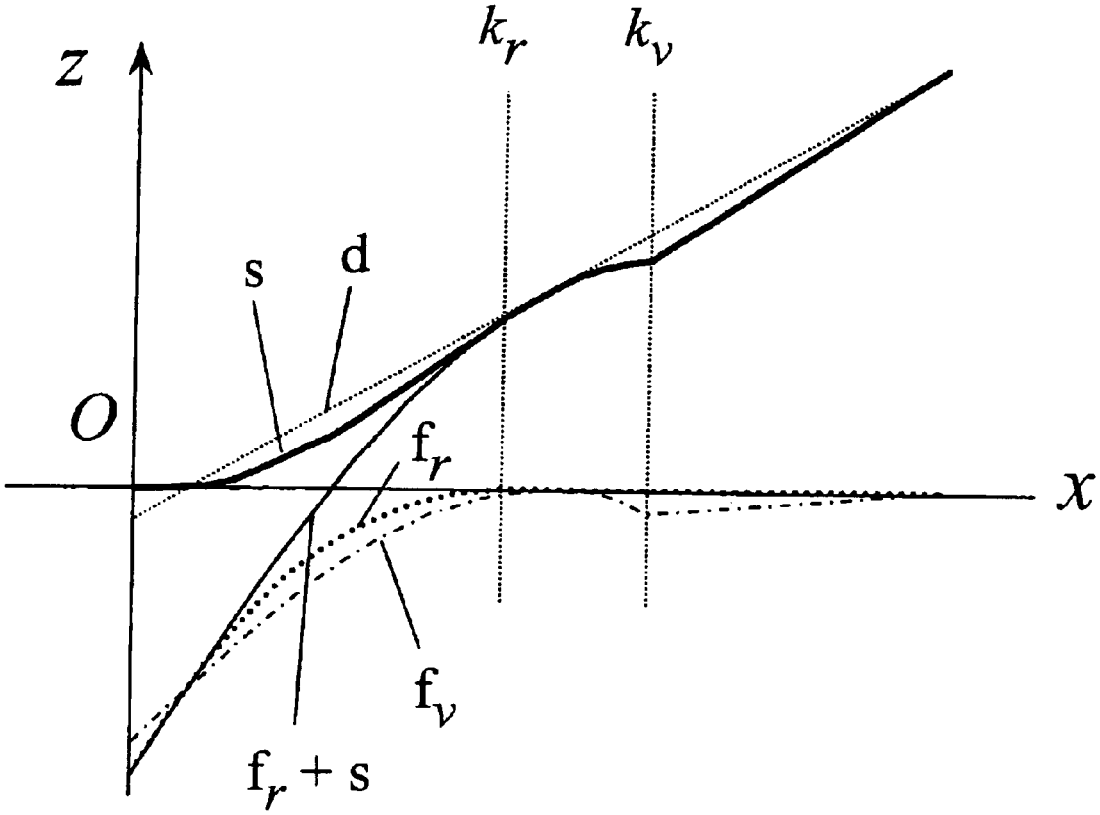

In FIGS. 1, 4 and 6, scale has not been respected. More specifically, the thickness of the inserts has been greatly exaggerated, so that their shape is visible.

The mouthpiece assembly shown in FIGS. 1 and 2 is of the type intended to be fitted to a clarinet. A similar model can be adapted to a saxophone or to any other instrument with a single beating reed. It includes a mouthpiece 10, a reed 12 and a ligature that has not been shown in the drawing, in order to make the parts involved in the invention more visible. As will be noted in the following description, these elements are those that are conventionally fitted to the instrument, without having undergone any transformation, or structural adaptation. The mouthpiece assembly also includes an insert 14, arranged between mouthpiece 10 and reed 12, and whose structure and function will be specified hereinafter.

In a conventional manner, mouthpiece 10 is made in a single part. It has an oblong shape, with a front part 16 intended to be placed in the mouth, and a cylindrical rear part, forming a tenon 18, and arranged to be fixed to the clarinet barrel. The front part 16 has a substantially conical shape, truncated by two surfaces 20 and 22. Surface 20 forms a face, called here the original face, including two portions, one of which 20*a*, substantially flat, is close to tenon 18, and the other 20*b*, which is curved, occupies the front of mouthpiece 10.

Tenon 18 has a generally cylindrical shape and carries, at its periphery and in an ad hoc concentric recess, a cork joint 24, intended to form a sealed connection with the barrel.

Surface 22 forms the part of the mouthpiece called the beak and forms, with surface 20, an acute angle, which defines the whistle shape of the end of the mouthpiece, also called the tip of the mouthpiece, in the part thereof that is placed in the mouth.

A channel passes through mouthpiece 10, connecting surface 20 to the central portion of tenon 18, and intended to ensure the passage of air from the mouth to the body of the instrument. It is formed of a chamber 26—delimited by a baffle 26*a*, a wall opposite the baffle or ramp and concealed in the drawing, and two side walls 26*b*—opening into portion 20*b* to define the part of the mouthpiece usually called the window, and a bore 27, of slightly conical form, concentric to the tenon, opening into the chamber and extending into the barrel then into the clarinet pipe, not shown in the drawing. Bore 27 delimits a column of air, made to vibrate via the effect of the reed vibrations and whose frequency defines the sound emitted. Reed 12 is formed, in a manner well known to those skilled in the art, of a plate usually made from a portion of natural reed of the *Arundo donax* species, having a flat lower surface which forms a table 28, a stock 30, convex on the side opposite table 28, which acts as a support for the ligature to secure reed 12 to mouthpiece 10, and a vamp 32, whose thinned structure enables it to vibrate. In FIG. 1, the reed is shown above the mouthpiece, so as to allow insert 14 to be seen. Table 28 has, however, been marked with dotted lines in its working position, identified by the reference 28'.

Insert 14 is formed of a stable and sufficiently flexible material to adhere without any difficulty to the mouthpiece face despite strong vibrations of the reed, for example aluminum or plastic material. As can be seen in FIGS. 3 and 4, it includes a rear portion 34, forming the body of the insert and allowing, depending upon its shape, the distance and inclination of reed 12 to be modified with reference to mouthpiece 10, a front portion 36 for adjusting the curvature features of portion 20*b*, and a median portion 38 connecting front and rear portions 36 and 34. This median portion 38 is required to extend front portion 36 or rear portion 34, depending upon the longitudinal position of the insert on mouthpiece 10. The distinction between these three portions 34, 36 and 38 is thus above all functional and not exclusively morphological, and it depends upon the curvature of the curved portion 20*b* of the mouthpiece face being used. The limits between portions 34, 36 and 38 indicated in FIGS. 3 and 4 are thus approximate, since said curvature is not a priori known.

In the embodiment shown in FIGS. 3 and 4, the thickness of the rear portion 34 is constant. The front portion has a chamfer 40, more clearly visible in FIG. 4, which thins out towards the end of mouthpiece 10, as well as two fingers 42 and 44 each extending over one of the sides of chamber 26 and partially covering the end of side walls 26*b* and defining a cut out portion 46 preventing chamber 26 being obstructed, even if insert 14 is arranged very far forward on mouthpiece 10. The thickness of the chamfer at its free end has to be as small as possible, generally less than 0.09 mm, with an apex angle smaller than or equal to 3°.

Until now, the reed was directly applied via its table 28, against the flat portion 20*a* of the original face. Because of the curved shape of portion 20*b*, the front portions of mouthpiece 10 and reed 12 are spaced apart from each other and form an opening 48 opening into chamber 26 and allowing the clarinetist to produce a sound due to oscillations of the reed, by insufflating air. Relative to the reed, insert 14, affixed to surface 20 and partially covering surface 20*b*, forms a new face, called here a virtual face, having a different curvature and/or length than curved portion 20*b*, depending upon the shape of insert 14.

The quality of the sounds emitted depends upon numerous parameters, particularly on the body of the instrument, but also on reed 12 and the manner in which it vibrates on mouthpiece 10. This part of the instrument is very sensitive to minute differences in its structure as well as to environmental, thermal, hygrometric and barometric conditions. Each time that a clarinetist performs, he has to choose a reed suited to the work to be played, the tonality of the instrument used and the acoustic environment. In order to increase the probability of having an optimal reed, the clarinetist has to "wear in" a large number, which is expensive and tiresome. Moreover, the optimum operating period of each reed is quite brief.

Insert 14 provides a simple, economic and original solution to the aforementioned problem, particularly because it fits any type of mouthpiece, without requiring any prior modification. Such a solution also allows a teacher to direct his pupil to more fitting embouchure and support techniques, by developing his flexibility and sensitivity to variations in sonority.

As will be specified hereinafter, the presence of this insert 14 modifies the conditions linking reed 12 to mouthpiece 10, and thus, the sound quality that is a function of the form, position and material forming insert 14.

More specifically, i has been observed that, for a given reed, the quality of the sounds generated depends, amongst other things, upon:

- the dimension of the opening comprised between the mouthpiece and the tip of the reed,
- the length, curvature and lateral asymmetry of the curved portion of the face,
- the interface conditions between the reed and the mouthpiece (in particular the elasticity, inertia and state of the surface), and
- the inclination of the reed with reference to the baffle.

All of these parameters can be adjusted by a suitable choice of insert, more particularly of its shape, surface state, the material of which it is formed, and its position on mouthpiece 10. The displacement of the insert can be significant, as can be seen in FIG. 2, where insert 14 has been shown in the median position, in full lines, and in the set back position, in dotted lines, the displacement being indicated by a double arrow.

FIGS. 3 and 4 show a range of inserts, assuring such adjustments, respectively seen from the top and the side. In these Figures, references have only been given for part of them, in order to avoid overloading the drawing. They have, seen from above, a generally rectangular shape. They could equally well have a trapezoidal shape, in order to better match the shape of surface 20.

Insert 14 shown at a is rectangular, cut out from a film of constant thickness. It is intended to be inserted between the flat portion 20*a* of the mouthpiece and table 28 of reed 12. The material chosen will define the interface qualities, whereas the thickness will assure adjustment of opening 48. This insert can also include a chamfer, as shown in FIG. 4, seen from the side, at h or i. In such case, it could slightly overlap onto curved portion 20*b*, not enough however to obstruct chamber 26 too much.

The inserts shown at b, c, d, e and f allow strong engagement on curved portion 20*b*, owing to cut out portion 46 with which they are provided, defined by fingers 42 and 44. This cut out portion 46 can have several shapes. Thus, it is a semi-ellipse at b and trapezoidal at c. At d, the trapezoidal shape is again shown, completed by a triangular structure. The inserts shown at e and f only include two very short fingers 42 and 44, so that cut out portion 46 is small.

Insert 14, shown in perspective at g in FIG. 4, has a very simple shape with rear portions 34 and 38 of constant thickness, whereas the front portion 36 forms chamfer 40. It can be achieved by superposing thin sheets, from several $\mu$m to several hundredths of a millimeter in thickness, for example of thermo-adhesive plastic, the sheets being fixed to each other by heating. It should be noted that the rear portion of the insert can be made using thicker sheets than the other parts, since the latter supports the stock of the reed whose vibration during the production of sound is negligible. The insert advantageously has a thickness comprised between 0.01 and 1 mm.

The embodiment illustrated at h is similar to g in its structure, the chamfer 40 being, however, regular and without any steps. Such a structure can be made by means of a sheet of aluminum alloy, whose edges are flattened in a roll mill. At i, the angle of chamfer 40 is greater than at h. Practice has shown that this angle is advantageously less than 3°, typically from 0.1 to 0.3°.

The embodiments shown at j, k and l are provided with a convex front portion 36. Rear portion 34 is bent towards its free part at j, decreases towards median portion 38 at k, whereas at l, the insert shown does not have a rear portion. Via the convex part of front portion 36, these latter structures allow a reduction in the length of the curved portion of the virtual mouthpiece face. The support conditions of reed 12 on portion 20*a* of the mouthpiece face, and thus of opening 48, can be modified as a function of the structure of rear portion 34.

The insert shown at m includes a thick rear portion 34 decreasing towards median portion 38, thus considerably modifying the support conditions of reed 12 on portion 20*a* of the face of mouthpiece 10. Its front portion 36, forming chamfer 40, has a concave shape, which only slightly modifies the shape of portion 20*b* in its front portion, whereas it greatly modifies its neighboring part of portion 20*a*. Consequently, the length of the virtual face is increased.

It thus appears that, by adding an insert between the reed and the mouthpiece of an instrument with a single beating reed, it is possible to control the interaction between the reed and the mouthpiece in a much more efficient manner, and thus to draw the maximum benefit from available reeds.

The shape of the inserts can also be mathematically defined, by modeling the profile of most original mouthpiece faces found on the market. The latter have, in fact, a shape that corresponds with an accuracy of more or less two hundredths of a millimeter to a continuous function $f_r$, defined by sections:

$$f_r: x \mapsto \begin{cases} p_{r,a}(x) & \text{if } x \le k_r \\ p_{r,b}(x) & \text{otherwise} \end{cases}$$

Where $p_{r,a}$ and $p_{r,b}$ are two fourth degree polynomials:

$$p_{r,a}: x \mapsto a_{r,0}+a_{r,1}x+a_{r,2}x^2+a_{r,3}x^3+a_{r,4}x^4$$

$$p_{r,b}: x \mapsto b_{r,0}+b_{r,1}x+b_{r,2}x^2+b_{r,3}x^3+b_{r,4}x^4$$

the coefficients $a_{r,0}$, $a_{r,1}$, $a_{r,2}$, $a_{r,3}$, $a_{r,4}$, $b_{r,0}$, $b_{r,1}$, $b_{r,2}$, $b_{r,3}$, $b_{r,4}$ and $k_r$ being real constants.

Since $f_r$ is continuous, we have:: $p_{r,a}(k_r)=p_{r,b}(k_r)$

The longitudinal axis Ox is defined as being the line of intersection between the plane of the table of a reed 12 secured to the original face and the plane of symmetry of the mouthpiece. The origin of the system of axes is on the Ox axis at the tapered end of the reed. The latter is centered laterally and arranged such that the tip of the mouthpiece also has 0 as the abscissa. The lateral axis Oy perpendicular to the Ox axis, is in the plane of the reed table, whereas the Oz axis is perpendicular to this latter plane (FIG. 5).

$f_r(x)$ defines the ordinate at z of an abscissa point x of the original mouthpiece face.

The constant $k_r$ forms the limit between curved portion 20*b* and the substantially flat portion 20*a* of a face referenced by this function. If this latter portion were perfectly flat, we would thus have $b_{r,0}=b_{r,1}=b_{r,2}=b_{r,3}=b_{r,4}=0$. In reality, it is generally very slightly concave.

In a similar manner to $f_r$ we will define a function $f_v$, corresponding to a virtual mouthpiece face to which an insert is affixed:

$$f_v: x \mapsto \begin{cases} p_{v,a}(x) & \text{if } x \le k_v \\ p_{v,b}(x) & \text{otherwise} \end{cases}$$

Where $p_{v,a}$ and $p_{v,h}$ are two fourth degree polynomials:

$$p_{v,a}: x \mapsto a_{v,0}+a_{v,1}x+a_{v,2}x^2+a_{v,3}x^3+a_{v,4}x^4$$

$$p_{v,b}: x \mapsto b_{v,0}+b_{v,1}x+b_{v,2}x^2+b_{v,3}x^3+b_{v,4}x^4$$

the coefficients $a_{v,0}$, $a_{v,1}$, $a_{v,2}$, $a_{v,3}$, $a_{v,4}$, $b_{v,0}$, $b_{v,1}$, $b_{v,2}$, $b_{v,3}$, $b_{v,4}$ and $k_v$ being real constants. Since $f_v$ is continuous, we have:: $p_{r,a}(k_r)=p_{r,b}(k_r)$ The Ox' axis is defined as being the line of intersection between the plane of table 28 of a reed fixed to the virtual face and the plane of symmetry of the mouthpiece. The origin of this new system of axes is found on the Ox' axis, at the tapered end of the reed. This latter is centered laterally and arranged such that the tip of the mouthpiece generally has 0 for abscissa. The Oy' axis, perpendicular to the Ox' axis is in the plane of the reed table, whereas the Ox' axis is perpendicular to this latter plane. $f_v(x')$ defines the ordinate z' of an abscissa point x' of the virtual mouthpiece face.

The two defined systems of axes are thus slightly shifted with respect to each other. Since the angle of the two axes is very small, we will consider that one abscissa point x has the same abscissa with respect to the two axes.

It should be noted, on the other hand, that the vibrating reed can move beyond its rest position; $p_{v,a}(x)$ can thus have a maximum for an x abscissa, slightly less than $k_v$ so as to control the reed also in this part of its vibration, as can be seen in FIG. 6.

The inserts allow a large variety of face forms to be obtained virtually, from a given original face, by giving suitable values to the coefficients $a_{v,0}$, $a_{v,1}$, $a_{v,2}$, $a_{v,3}$, $a_{v,4}$, $b_{v,0}$, $b_{v,1}$, $b_{v,2}$, $b_{v,3}$, $b_{v,4}$ and $k_v$.

In practice, since useful corrections are modest and the angular difference in the reed with reference to the mouthpiece baffle induced by the presence of the insert is small, the thickness of the insert can be inferred directly by subtracting one function from the other then adding an affine function d (straight line):

$$d: x \mapsto d_0+d_1x$$

chosen such that the function s representing its thickness $s=f_v-f_r+d$ is always positive over the entire length of the face and so that it tends towards zero at the tip of the mouthpiece (more or less a tolerance of the order of a hundredth of a millimeter). These operations are illustrated graphically in FIG. 6. More specifically, the functions $f_r$, $f_v$, d and s as well as the abscissas of constants $k_r$ and $k_v$ are represented. It will be noted that the straight line d coincides with the Ox' axis when the insert represented by s is superposed on the original face of the mouthpiece represented by $f_r$. It can be seen that the virtual face $f_v$ with respect to a reed placed on the Ox axis is equivalent to the original face plus the insert ($f_r$+s)when a reed is placed on the Ox' axis (taking due account of the fact that the scale of the Oz axis is greatly enlarged, in this case of the order of thirty times).

Let us summarize the foregoing taking account of the mathematical properties of polynomials: usually, the longitudinal thickness of the insert substantially follows a continuous function defined by sections, by means of three fourth degree polynomials, delimited by the constants $k_r$ and $k_v$, as well as by the minimal thickness and the maximal length that one wishes to give it. Outside these two external limits, the thickness of the insert is zero. Generally, the thickness is constant laterally, unless one wishes to give it lateral asymmetry.

It should be stressed that all of the embodiments illustrated in FIG. 4 answer the definition of the preceding paragraph, including the insert shown at g provided that the sheets forming it are sufficiently thin.

For the record, it should be mentioned that predicting the behavior of a given mouthpiece face of function f is difficult, from both the technical and musical point of view. It becomes slightly more convenient when a mathematical transformation is performed beforehand allowing the distance g(x) traveled by the thinned end of a reed between its rest position and the position that it would have perfectly matching the curvature of the face to an abscissa point x, to be calculated. The reed table is extended then along the tangent at this point, in a perfectly rectilinear manner to abscissa 0.

This is translated mathematically by the following differential equation:

$$f'(x) = \frac{f(x) - g(x)}{x}$$

Where f' is the first derivative of function f. Assuming that function g is a fourth degree polynomial, $$g: x \mapsto c_0+c_1x+c_2x^2+c_3x^3+c_4x^4$$

the differential equation can be resolved: one obtains:

$$f(x) = c_0 - c_1 x\ln(x) - c_2x^2 - \frac{1}{2}c_3x^3 - \frac{1}{3}c_4x^4 - hx$$

where the integration constant h has a value:

$$h = \frac{c_0 - c_1x_0\ln(x_0) - c_2x_0^2 - \frac{1}{2}c_3x_0^3 - \frac{1}{3}c_4x_0^4}{x_0}$$

$x_0$ being a real zero of the function g such that $$g(x_0)=f(x_0)=0.$$

The volume of air v displaced by the reed between the position g(0) and the position g(x) of its thinned end can be calculated by the function:

$$v: x \mapsto \frac{1}{4}c_1x^2 + \frac{1}{3}c_2x^3 + \frac{3}{8}c_3x^4 + \frac{2}{5}c_4x^5$$

Empirical tests have demonstrated that it is possible to neglect the coefficient $c_1$, which then means that f is a fourth degree polynomial and that g'(0)=0.

Using the equations hereinbefore and the shape of the reed, a material engineer can estimate the stress that the reed undergoes during sound production. It is thus possible to create a range of inserts controlling the intensity and positioning of the stresses that one wishes the reed to undergo so as to optimize its longevity.

Empirically, it has been observed that the latter can be seriously prolonged, starting by exploiting the elastic potential of a new reed where it is very thick, using a mouthpiece face combining the following features: small opening, large length and small curvature. Progressively as the reed becomes suppler, it is possible to stress increasingly the zones where the reed is thinner by increasing the opening and the curvature while reducing the length. Using a conventional mouthpiece without using the insert, the instrumentalist would be obliged to compress the reed with his lips and consequently exploit a thinner zone of the reed. Once this zone is weakened, it is no longer possible to use thicker zones with a musically satisfactory result, which considerably decreases the longevity of the reed.

In order to use the insert and in order to facilitate the positioning thereof, while allowing it to move, its surface intended to come into contact with the face of mouthpiece 10 is advantageously coated with a layer of adhesive of the repositionable type such as those marketed by 3M® (USA). This layer of relatively soft material modifies the interface conditions between reed 12' and mouthpiece 10, which is why it may be advantageous for it to be applied only over a small portion of the length of the insert, chosen according to the desired result. In all cases, it is preferable for it not to totally cover the surface of the insert, in order to facilitate its removal.

It is evident that the embodiments given here represent only an example of the possible solutions. Other materials could thus be implemented, chosen for their rigidity, their elasticity or their ability to dampen a vibration, as well as for their ease of use.

It is also possible to provide other insert shapes, both as regards front portion 36, rear portion 34 and median portion 38, it is thus possible to have a thickness that varies laterally, such that the insert is thicker on the edges, or conversely, thinner, or exhibiting lateral asymmetry, such that the curvatures of the virtual face are not the same on either side of chamber 26. Such an arrangement allows the effect of any asymmetry in the clarinetist's mouth to be corrected, as well as that of the reed, and more gradual control of the acoustic power.

In order to improve the fixing of the inserts to mouthpiece 10, it is also possible to make inserts provided with lateral positioning means, made by folding its front portion 36, engaging in chamber 26 and/or matching the shape of the exterior of mouthpiece 10.

The solution described with reference to a mouthpiece assembly for a clarinet is, of course, also applicable to other instruments with a single beating reed, particularly to the saxophone. The dimensions of the inserts will then be adapted to this instrument.

It is also possible to place several superposed or juxtaposed inserts to obtain the desired effect.

Generally, insert 14 is affixed to the face of mouthpiece 10. One could, however, also envisage applying it to table 28 of reed 12.

In order to facilitate the adjustment of the insert's position, it is advantageous to provide with an index or a scale referencing its longitudinal position that the instrumentalist will have to match to a mark on the mouthpiece, like for example, the first centering ring of the ligature.

What is claimed is:

1. Mouthpiece assembly for a reed instrument, including:

a mouthpiece (10) provided with:

a chamber (26), including a baffle (26*a*), a wall opposite the baffle or ramp and two side walls (26*b*), and a bore (27), for allowing air to flow and sound waves to circulate towards the pipe of the instrument, and a first original face, including a curved portion (20*b*), arranged laterally on either side of the chamber (26) and forming the end of said walls (26*b*), and a substantially flat portion (20*a*) arranged above the chamber (26) and the bore (27), in the extension of the curved portion (20*b*), a reed (12) including a stock (30), intended to be secured to the mouthpiece, a vamp (32) intended to vibrate, and a table (28), extending over its entire length and forming one of the surfaces of the stock (30) and the vamp (32), arranged to be supported, via the portion of its table (28) associated with the stock (30) against the flat portion (20*a*) of the first face, and a ligature, for assuring the assembling of the reed (12) on the mouthpiece (10), wherein the mouthpiece (10) and the reed (12) define between them an opening (48) allowing air to penetrate, to generate sound vibrations, the air then flowing into the chamber (26) and into the bore (27), in a generally longitudinal direction, characterized in that it further includes, present during the production of sound, a removable insert (14) taking the form of a patch, gripped between the mouthpiece face (20) and the reed table (28), and arranged so as to define, with the first face, a second virtual face, as a function of the forms of the first face (20), the insert (14) and the position of said insert (14) on the first face (20).

2. Mouthpiece assembly according to claim 1, characterized in that said insert (14) covers a part of said curved portion (20*b*).

3. Insert (14) intended to be gripped between the reed (12) and the mouthpiece (10) of the mouthpiece assembly according to claim 1, characterized in that it has a chamfer (40) at at least one of its ends intended to be arranged facing the vamp (32) of the reed (12).

4. Insert according to claim 3, characterized in that its thickness is variable along the longitudinal side, substantially following a continuous function defined by sections, said sections being three in number and each being formed of a fourth degree polynomial, one of which, over a length of more than 2 millimeters, has at least two non zero coefficients.

5. Insert according to 3, characterized in that the thickness of the end of said chamfer is less than 0.09 millimeters.

6. Insert according to claim 3, characterized in that said film is formed of superposed thin sheets fixed to each other, the number of superposed sheets decreasing to form said chamfer (40).

7. Insert according to claim 3, characterized in that the angle at the apex of said chamfer (40) is less than 3°.

8. Insert according to claim 3, characterized in that its end (36) including said chamfer (40) is provided with a cut out portion (46) made in its entire thickness and arranged laterally in its median portion.

9. Insert according to claim 8, characterized in that said cut out portion (46), intended to improve the clearing of access to the chamber (26), is defined by two fingers (42, 44) arranged so as to rest on said curved portion **(20*b*)**.

10. Insert according to claim 3, characterized in that it is formed of a material capable of being worked by plastic transformation.

11. Insert according to claim 10, characterized in that said material is an aluminum alloy.

12. Insert according to claim 10, characterized in that said material is a plastic material.

13. Insert according to claim 12, characterized in that said material is of the thermoformable type.

14. Insert according to claim 3, characterized in that at least one part of its surface intended to be in contact with the reed (12) and/or the mouthpiece (10) is provided with a repositionable type adhesive layer.

15. Insert according to claim 4, characterized in that the thickness of the end of said chamfer is less than 0.09 millimeters.

16. Insert according to claim 4, characterized in that said film is formed of superposed thin sheets fixed to each other, the number of superposed sheets decreasing to form said chamfer (40).

17. Insert according to claim 5, characterized in that said film is formed of superposed thin sheets fixed to each other, the number of superposed sheets decreasing to form said chamfer (40).

18. Insert according to claim 4, characterized in that the angle at the apex of said chamfer (40) is less than 3°.

19. Insert according to claim 5, characterized in that the angle at the apex of said chamfer (40) is less than 3°.

20. Insert according to claim 6, characterized in that the angle at the apex of said chamfer (40) is less than 3°.

* * * * *